US009391430B2

(12) United States Patent
Berkemeier et al.

(10) Patent No.: US 9,391,430 B2
(45) Date of Patent: Jul. 12, 2016

(54) IGNITION PLUG AND METHOD FOR THE IGNITION OF A FUEL-AIR MIXTURE BY MEANS OF AN IGNITION PLUG OF SAID TYPE

(71) Applicant: Ford Global Technologies, LLC, Deaborn, MI (US)

(72) Inventors: Oliver Berkemeier, Bergisch Gladbach (DE); Klemens Grieser, Langenfeld (DE)

(73) Assignee: Ford Global Technologies, LLC, Dearborn, MI (US)

( * ) Notice: Subject to any disclaimer, the term of this patent is extended or adjusted under 35 U.S.C. 154(b) by 187 days.

(21) Appl. No.: 14/156,288

(22) Filed: Jan. 15, 2014

(65) Prior Publication Data

US 2014/0209076 A1 Jul. 31, 2014

(30) Foreign Application Priority Data

Jan. 25, 2013 (DE) ..... 10 2013 201 187

(51) Int. Cl.
*H01T 13/26* (2006.01)
*F02P 9/00* (2006.01)
*F02P 17/12* (2006.01)

(52) U.S. Cl.
CPC ..... *H01T 13/26* (2013.01); *F02P 9/002* (2013.01); *F02P 17/12* (2013.01)

(58) Field of Classification Search
CPC ..... H01T 13/24; H01T 13/26; F02P 9/00; F02P 17/12; F02P 9/002
See application file for complete search history.

(56) References Cited

U.S. PATENT DOCUMENTS

| | | | | | |
|---|---|---|---|---|---|
| 5,463,267 | A * | 10/1995 | Conway | H01T 13/26 | 313/125 |
| 6,586,865 | B1 * | 7/2003 | Tamai | H01T 13/26 | 313/125 |
| 2003/0089325 | A1 * | 5/2003 | Marforio | F02P 15/04 | 123/159 |

FOREIGN PATENT DOCUMENTS

| | | | |
|---|---|---|---|
| DE | 69412833 | T2 | 4/1999 |
| DE | 19901283 | A1 | 8/2000 |
| DE | 10085340 | T5 | 4/2004 |
| DE | 102006001883 | A1 | 7/2007 |
| DE | 102006037412 | A1 | 2/2008 |
| JP | H09219275 | A | 8/1997 |

* cited by examiner

*Primary Examiner* — Lindsay Low
*Assistant Examiner* — Jacob Amick
(74) *Attorney, Agent, or Firm* — Julia Voutyras; Alleman Hall McCoy Russell & Tuttle LLP

(57) ABSTRACT

An adjustable ignition plug, with one or more variable electrodes, and a method to adjust the electrode gap spacing based on various engine operating parameters. This better enables the reliable ignition of the air-fuel mixture in a cylinder of a direct-injection internal combustion engine under various engine operating conditions.

17 Claims, 4 Drawing Sheets

IGNITION PLUG AND METHOD FOR THE IGNITION OF A FUEL-AIR MIXTURE BY MEANS OF AN IGNITION PLUG OF SAID TYPE

CROSS REFERENCE TO RELATED APPLICATIONS

The present application claims priority to German Patent Application No. 102013201187.3, filed on Jan. 25, 2013, the entire contents of which are hereby incorporated by reference for all purposes.

BACKGROUND/SUMMARY

An ignition plug may be used to ignite a fuel-air mixture in a cylinder of a direct-injection, applied ignition internal combustion engine. The ignition plug may include at least one electrode pair with two electrodes which are electrically insulated and spaced apart from one another. The first electrode may serve as the ground. The spacing between the first and second electrodes is the ignition gap in which the spark path forms during the course of applied ignition.

One approach to adjust ignition performance is to employ an ignition plug with variable electrode spacing as a function of the present operating temperature of the internal combustion engine. In one example, the ignition plug has relatively small electrode spacing at low temperatures and increases the spacing as temperature increases to higher values. Another example has the electrode spacing initially increasing with increasing temperature during the warm-up phase and then decreasing the electrode spacing with further increasing engine operating temperatures beyond a predefined threshold temperature. Both approaches use a bimetallic element having two components with different thermal expansion properties.

Some of the problems recognized by the inventors with the previous ignition plug with variable electrode spacing as a function of the present engine operating temperature come from increasing the spacing as temperature increases or to a predefined threshold temperature. An ignition plug of said type has a relatively small spacing during the warm-up phase in both approaches, which can degrade reliable ignition of the fuel-air mixture during the warm-up phase. Further, the inventors have recognized that a large gap at part load operation and a small gap at high load operation better enables reliable ignition of the fuel-air mixture during selected conditions.

In one example the problems described herein may be at least partly addressed by an ignition plug comprises two electrodes which are electrically insulated with respect to and spaced apart from one another. Further the first electrode serves as the ground electrode and the spacing between the first electrode and second electrode may be adjusted for various engine operating parameters using an adjustment device. The first electrode, second electrode, or both the first and second electrode may be movable. This may better enable control over the ignition gap spacing.

In another example, a method for control of a spacing between a first electrode and a second electrode of an ignition plug by means of an adjustment control device as a function of at least one operating parameter of an internal combustion engine wherein an ignition gap spacing can be set variably during engine operation, wherein the method further comprises at least one or more engine operating parameters that may be measured and/or estimated to better enable ignition of a fuel-air mixture. This may provide reliable ignition of the fuel-air mixture over a variety of engine operating conditions.

DETAILED DESCRIPTION

Figure 1:
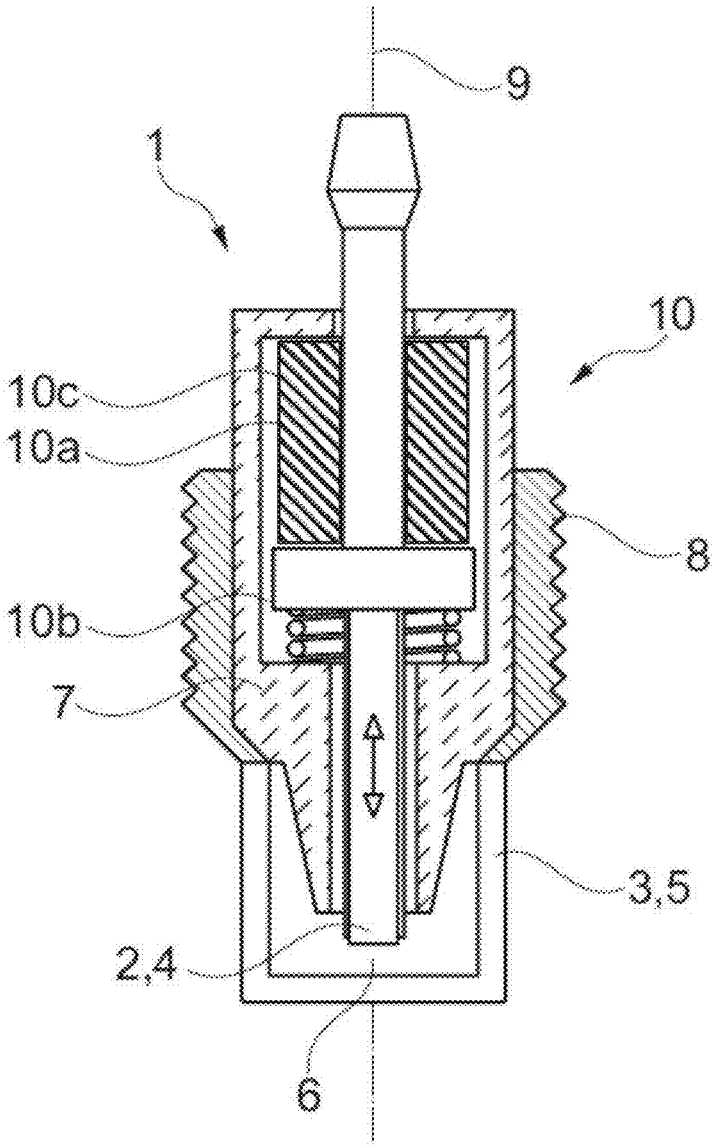
FIG. 1 schematically shows a first embodiment t of the ignition plug in a side view, and partially in section.

The ignition plug for igniting a fuel-air mixture in a cylinder of a direct-injection, applied-ignition internal combustion engine, in which ignition plug has at least one electrode pair which comprises two electrodes which are electrically insulated with respect to and spaced apart from one another, of which a first electrode serves as a ground electrode, the spacing between the first electrode and the second electrode in an ignition gap in which a spark path forms during the course of the applied ignition being variable.

Further a method is provided for the improved ignition of a fuel-air mixture in a cylinder of a direct-injection, applied-ignition internal combustion engine by using an ignition plug of said type.

Owing to the limited availability of mineral oil as a raw material for the production of fuels for internal combustion engines, it is sought to minimize fuel consumption.

A problem is the fuel consumption owing to the relatively poor efficiency in particular of Otto-cycle engines. The reason for this lies in the principle of the operating process of the traditional Otto-cycle engine. The traditional Otto-cycle engine operates with a homogeneous fuel-air mixture prepared by external mixture formation by virtue of fuel being introduced into the air situated in the intake tract. The power or load is set by varying the charge of the combustion chamber, such that the working process of the Otto-cycle engine—in contrast to the diesel engine—is based on quantity regulation.

Said load control is generally performed by means of a throttle flap provided in the intake tract. By adjusting the throttle flap, the pressure of the inducted air downstream of the throttle flap can be reduced to a greater or lesser extent. The further the throttle flap is closed, the more the flap blocks the intake tract, the higher is the pressure loss of the inducted air across the throttle flap, and the lower is the pressure of the inducted air downstream of the throttle flap and upstream of the inlet into the combustion chamber of the cylinder. It is possible in this way for the air mass, that is to say the quantity, to be set by means of the pressure of the inducted air. This type of load control has proven to be disadvantageous in particular in the part-load range because low loads require a significant pressure reduction, that is to say intense throttling, whereby the charge exchange losses increase with decreasing load.

To reduce the described throttling losses, various strategies for dethrottling have been developed. One approach to a solution for dethrottling an Otto-cycle engine is for example an Otto-cycle engine working process with direct injection. The direct injection of the fuel is a suitable means for realizing a stratified combustion chamber charge, that is to say stratified-charge operation, which permits considerable leaning of the mixture and thus requires reduced throttling of the charge air. This offers thermodynamic advantages in particular in the part-load range, which is to say in the low-load and medium-load range, when only small amounts of fuel are to be injected. The method also utilizes the direct injection of the fuel.

Further advantages arise owing to the internal cooling of the combustion chamber and of the mixture that is associated with a direct injection, whereby increased compression and/or supercharging and consequently improved utilization of the fuel is made possible without the early auto-ignition of the fuel, so-called knocking, that is otherwise characteristic of the Otto-cycle engine.

Stratified-charge operation is characterized by an extremely inhomogeneous combustion chamber charge, wherein an ignitable fuel-air mixture with relatively high fuel concentration ($\lambda<1$) is realized in the vicinity of the ignition plug, whereas lower fuel concentrations, that is to say higher local air ratios ($\zeta>1$), are present in the mixture layers situated therebelow. This leads to an altogether very lean combustion chamber charge with an overall air ratio of $\lambda>>1$.

Conventionally the air ratio $\lambda$ is defined as the ratio of the air mass $m_{air,act}$ actually supplied to the at least one cylinder of the internal combustion engine to the stoichiometric air mass $m_{air,stoich}$ that would be required to just completely oxidize the fuel mass $m_{fuel}$ supplied to the at least one cylinder (stoichiometric operation of the internal combustion engine $\lambda=1$). It follows that $\lambda=m_{air,act}/m_{air,stoich}$.

Only relatively short time periods in the range of milliseconds are available for the injection of the fuel, for the mixture preparation in the combustion chamber, that is to say the mixing of air and fuel—if desired—and the preparation of the fuel within the context of preliminary reactions including evaporation, and for the ignition of the prepared mixture. Therefore, the demands on the ignition and on the ignition plug are significantly higher than in the case of traditional Otto-cycle processes in order to be able to ensure reliable ignition even under the more difficult conditions.

During the operation of the direct-injection Otto-cycle engine, the overall air ratio $\lambda$ varies as a function of the present load. Here, the internal combustion engine is generally operated lean ($\lambda>1$), with an excess of air, in part-load operation, and possibly also rich ($\lambda<1$), with an air deficiency, at relatively high loads and at full load. The variation of the overall air ratio $\lambda$ also leads to greater demands on the ignition plug, because reliable ignition of the fuel-air mixture must be ensured at all loads and under an extremely wide range of overall air ratios $\lambda$.

In particular, misfiring, which leads not only to rotational irregularities, that is to say rotational speed fluctuations of the internal combustion engine, but also to increased pollutant emissions, in particular to increased emissions of unburned hydrocarbons, should be prevented.

To be able to reliably ignite lean mixtures, a relatively large spacing between the two electrodes is preferable or desired in order that an adequately large proportion of fuel molecules passes into the ignition gap, in which the spark path is formed during the course of the applied ignition, of the ignition plug despite the excess of air in the combustion chamber.

A relatively large electrode spacing is also preferable in the event of a cold start of the internal combustion engine in order to also ensure reliable ignition of the fuel-air mixture during the warm-up phase, when the operating temperatures are still relatively low.

The ignitability or combustibility of the fuel-air mixture is also influenced by the exhaust-gas recirculation, that is to say the exhaust-gas quantity recirculated from the outlet side to the inlet side. Exhaust-gas recirculation is suitable for reducing the untreated nitrogen oxide emissions, wherein the untreated nitrogen oxide emissions can be reduced considerably with increasing exhaust-gas recirculation rate. Here, the exhaust-gas recirculation rate $x_{EGR}$ is determined as $x_{EGR}=m_{EGR}/(m_{EGR}+m_{fresh\ air})$, where $m_{EGR}$ denotes the mass of recirculated exhaust gas and $m_{fresh\ air}$ denotes the supplied fresh air which is, if appropriate, conducted through a compressor and compressed. To obtain a considerable reduction in nitrogen oxide emissions, high exhaust-gas recirculation rates are required which may be of the order of magnitude of $x_{EGR}\approx 60\%$ to 70%. Exhaust-gas recirculation may furthermore be used at high loads in order to reduce the knocking tendency. A large or relatively large electrode spacing is preferable at high recirculation rates, or an increase of the electrode spacing is preferable with increasing recirculation rate, in order to ensure reliable ignition of the fuel-air-exhaust gas mixture with an acceptable ignition voltage.

By contrast, for high loads and full load operation, a reduced, that is to say relatively small spacing of the electrodes is preferable, wherein a minimum spacing should not be undershot in order to avoid an unacceptably high level of burn-off of the two electrodes. A reduced electrode spacing is basically preferred if the ignition voltage required for reliable ignition rises to an undesirably great extent, that is to say assumes undesirably high values. The ignition voltage that is then actually required can thus be reduced.

The statements made above show that an ignition plug with variable electrode spacing would be extremely advantageous in order to ensure reliable ignition under all operating conditions in a direct-injection, applied-ignition internal combustion engine.

U.S. Pat. No. 6,586,865 B1 describes an ignition plug of the type mentioned in the introduction, in which the spacing of the electrodes varies as a function of the present operating temperature of the internal combustion engine. Here, one electrode of the ignition plug is in the form of a bimetallic element which comprises two components arranged in layers, the thermal expansion properties of which components differ. Here, the two components are selected and arranged with regard to their expansion properties such that, proceeding from a state in which the internal combustion engine is cold, the spacing between the first electrode and the second electrode increases with rising operating temperature during the course of the warm-up phase. An ignition plug of said type has a relatively small electrode spacing during the warm-up phase and has an increased spacing in part-load operation or lean-burn operation, but does not have a reduced spacing at relatively high loads.

A further developed ignition plug of the type in question, that is to say an ignition plug in which the spacing between the two electrodes is variable, is also described in the German laid-open specification DE 10 2006 037 412 A1. To realize a changeable, that is to say variable spacing, it is again provided that at least one of the two electrodes is in the form of a bimetallic element, wherein the bimetallic element comprises two components, the thermal expansion properties of which components differ. In order that, proceeding from a state in which the internal combustion engine is cold, the spacing between the electrodes initially increases with rising operating temperature during the course of a warm-up phase, and then decreases again with further increasing operating temperature beyond a point at which a predefinable threshold temperature is overshot, a targeted selection of the two components used to form the bimetallic element is necessary. The two components therefore have expansion properties that are coordinated with one another, wherein the second component exhibits reduced expansion behavior in relation to the first component in a first temperature range and exhibits increased expansion behavior in relation to the first component in an adjoining temperature range.

A disadvantage of the ignition plug from DE 10 2006 037 412 A1 is that the spacing between the electrodes varies automatically and exclusively as a function of the temperature prevailing in the cylinder of the internal combustion engine. A targeted adjustment of the spacing of the electrodes in the ignition gap according to demand is not possible, that is to say it is not possible to realize an electrode spacing that is optimized in an operating-point-specific manner. In particular, it is not possible for the spacing between the electrodes to be varied, that is to say adjusted, as a function of the exhaust-gas recirculation rate $x_{EGR}$ and/or the overall air ratio $\lambda$.

Against this background, an ignition plug according to the preamble of claim 1 which permits reliable ignition of the fuel-air mixture situated in a cylinder of the direct-injection internal combustion engine, under all operating conditions is provided.

It is a further sub-object to specify a method for the ignition of a fuel-air mixture using an ignition plug of said type.

The first object is achieved by means of an ignition plug for igniting a fuel-air mixture in a cylinder of a direct-injection, applied-ignition internal combustion engine, which ignition plug has at least one electrode pair which comprises two electrodes which are electrically insulated with respect to and spaced apart from one another, of which a first electrode serves as a ground electrode, the spacing between the first electrode and the second electrode in an ignition gap in which a spark path forms during the course of the applied ignition being variable, and wherein at least one of the two electrodes is designed to be movable for the purpose of adjustment of the spacing in the ignition gap, for which purpose an adjustment device is provided.

The ignition plug has an adjustment device by means of which the electrode spacing can be influenced in a targeted manner, that is to say the spacing between the two electrodes in the ignition gap can be actively controlled. For this purpose, at least one of the two electrodes is designed to be movable, such that said at least one movable electrode can be moved by means of the adjustment device, that is to say moved toward the other electrode in order to decrease the spacing in the ignition gap and moved away from the other electrode in order to increase the spacing in the ignition gap.

The at least one movable electrode can be moved, and transferred from one working position into another working position, in a targeted manner by means of the adjustment device.

In this respect, the ignition plug permits an operating-point-specific adjustment of the spacing of the electrodes in the ignition gap, that is to say makes it possible to set the optimum electrode spacing for various operating points of the internal combustion engine fly contrast to the prior art, in which only the temperature in the cylinder in the vicinity of the electrode pair is taken into consideration, it is possible for the spacing between the electrodes to be controlled, that is to say adjusted, as a function of a variety of desired operating parameter, in particular also varied, that is to say adjusted, as a function of the exhaust-gas recirculation rate $x_{EGR}$ and/or the overall air ratio $\lambda$.

In this way, the first object is achieved, that is to say an ignition plug is provided which permits reliable ignition of the fuel-air mixture situated in a cylinder of the direct-injection internal combustion engine, under all operating conditions.

The ignition plug can satisfy the various demands on the electrode spacing.

It is thus possible to realize relatively large or increased electrode spacing for a cold start of the internal combustion engine. Lean mixtures can likewise be reliably ignited by means of an increased spacing, whereby allowance can be made for the air ratios that prevail at part load. The same applies to operating states with exhaust-gas recirculation. Toward high loads, and at full load, the spacing of the electrodes can be reduced according to demand, that is to say decreased electrode spacing can be set.

Furthermore, the ignition plug makes it possible for an increase of the electrode spacing resulting from wear-induced burn-off of the electrodes to be compensated, that is to say offset, by readjustment of the at least one movably designed electrode. This considerably increases the service life of the ignition plug because, if the spacing increases as a result of wear with progressive operating duration, an ever increasing ignition voltage is considered to form a spark path, wherein the increased ignition voltage in turn results in increased burn-off.

Embodiments of the ignition plug are advantageous in which the spacing of the electrodes can be adjusted in a continuously variable manner. Embodiments of the ignition plug are however also advantageous in which the spacing of the electrodes can be adjusted in stages, in particular in multi-stage fashion or else in two-stage fashion.

Further advantageous embodiments of the ignition plug will be discussed in conjunction with the subclaims.

Embodiments of the ignition plug are advantageous in which the at least one electrode that is designed to be movable is the ground electrode.

Embodiments of the ignition plug are also advantageous in which both electrodes of the electrode pair are designed to be movable.

In particular, embodiments of the ignition plug are advantageous in which a central electrode is provided which is arranged in a housing of the ignition plug and which is electrically insulated from the ground electrode by means of an insulator.

Here, embodiments of the ignition plug are advantageous in which the central electrode is the at least one electrode that is designed to be movable, the ground electrode being designed to be immovable. The central electrode is particularly suitable for being designed as a movable electrode because the ground electrode generally surrounds the central electrode at the combustion chamber side, in a similar manner to a cap.

In this connection, embodiments of the ignition plug are likewise advantageous in which the central electrode is displaceable in translatory fashion in the housing by means of an adjustment device, the ground electrode being rigidly connected to the housing.

Here, the spacing between the two electrodes in the ignition gap is adjusted by a translatory displacement of the central electrode, wherein the central electrode is moved toward the ground electrode in order to decrease the spacing in the ignition gap and is moved away from the ground electrode in order to increase the spacing in the ignition gap. For example, a temperature reactive wax, solenoid, actuator, etc may be used to adjust the displacement of the electrode.

Embodiments of the ignition plug are advantageous in which the adjustment device comprises at least one temperature-reactive wax element whose volume changes as a function of temperature, the change in volume of the wax element leading to a movement of the at least one electrode that is designed to be movable.

The temperature-reactive wax element functions as an adjustment device or as part of an adjustment device. The wax element need merely be thermally activated. The thermal activation, that is to say the change, in particular the increase, of the temperature of the wax element leads to a change in volume, wherein the change in volume of the wax element is in the present case utilized for moving the electrode that is designed to be movable. The activation of the wax element may be realized in a variety of ways, for example—as will be explained in ore detail further below—by means of a heating element.

Embodiments of the ignition plug may also be advantageous in which a mechanical adjustment device is provided.

If a temperature-reactive wax element is used to form the adjustment device, embodiments of the ignition plug are advantageous in which the at least one temperature-reactive wax element is arranged in a working chamber and, when activated by means of an increase in temperature, actuates a displacement mechanism which effects a movement of the at least one electrode that is designed to be movable.

The wax element is intended to effect, when activated, a movement of the at least one electrode that is designed to be movable. To actuate the actuator of a displacement mechanism by means of a change in volume, and to be able to build up the force needed for his purpose, it is advantageous for the wax element to be arranged in a working chamber which basically counteracts a change in volume, that is to say initially opposes an expansion of the wax element. The change in volume is transmitted, in a manner controlled by means of and in the working chamber, to an actuator which serves to actuate a displacement mechanism which effects a movement of the at least one electrode that is designed to be movable.

Depending on the operating principle or construction of the displacement mechanism, the wax element that expands when activated, that is to say the expansion of the wax element, can lead to, that is to say be utilized for, a decrease or increase of the electrode spacing in the ignition gap.

In particular, embodiments of the ignition plug are advantageous in which the temperature-reactive wax element, when activated by means of an increase in temperature, effects a reduction of the spacing in the ignition gap as a result of a movement of the at least one electrode that is designed to be movable.

The wax element could then be activated inter alia at relatively high load, or toward high loads, in order to effect a decrease of the electrode spacing in the ignition gap.

Furthermore, embodiments of the ignition plug are advantageous in which the temperature-reactive wax element is actively controllable. Said embodiment permits characteristic-map-specific control of the wax element, and thus operating-point-specific adjustment of the electrode spacing.

Here, embodiments of the ignition plug are advantageous in which the temperature-reactive wax element is actively controllable by means of a heating element and/or an engine controller.

If the temperature-reactive wax element is actively controllable, embodiments are advantageous in which the temperature-reactive wax element is electrically controllable. Electrically controlled wax elements have the advantage that they are compatible with the conventional control technology of an internal combustion engine. Furthermore, an electrical controller can utilize the on-board battery in a simple manner.

The second sub-object, specifically that of specifying a method for the ignition of a fuel-air mixture using an ignition plug of an above-described type, is achieved by means of a method wherein the spacing between the two electrodes in a region in which a spark path is formed during the course of the applied ignition is varied, by means of an adjustment device, as a function of at least one operating parameter of the internal combustion engine.

That which has already been stated with regard to the ignition plug also applies to the method.

Embodiments of the method are advantageous in which, with increasing exhaust-gas recirculation rate $x_{EGR}$, the spacing between the two electrodes is increased.

The exhaust-gas recirculation has an influence on the ignitability or combustibility of the fuel-air mixture. A relatively large electrode spacing is preferable at high recirculation rates, or an increase of the electrode spacing is preferable with increasing recirculation rate, in order to be able to realize reliable ignition of the fuel-air-exhaust gas mixture.

Embodiments of the method are basically advantageous in which, in order to reduce the ignition voltage, the spacing between the two electrodes is decreased.

Embodiments of the method are advantageous in which, with increasing air ratio $\lambda$ in the case of lean fuel-air mixtures ($\lambda>1$), the spacing between the two electrodes is increased.

To be able to reliably ignite lean mixtures, a relatively large spacing between the two electrodes is required in order that an adequately large proportion of fuel molecules passes into the ignition gap, in which the spark path is formed during the course of the applied ignition, of the ignition plug despite the excess of air in the combustion chamber.

Embodiments of the method are advantageous in which, with increasing load proceeding from a state in which the internal combustion engine is in part-load operation, the spacing between the two electrodes is decreased.

Whereas the mixtures, that are generally relatively lean, in part-load operation require a relatively large spacing between the two electrodes, a small spacing between the electrodes is preferable for high loads and full-load operation, in particular also with regard to the required ignition voltage.

Embodiments of the method are advantageous in which, for a cold start of the internal combustion engine, the spacing between the two electrodes is increased.

A relatively large or large electrode spacing is preferable during a cold start in order to ensure a reliable ignition of the fuel-air mixture at low operating temperatures.

To ensure reliable ignition of the fuel-air mixture during starting of the internal combustion engine, in particular during a cold start, it is often the case in the starting phase that a multiple of the fuel mass $m_{fuel,stoich}$ that could be burned stoichiometrically with the charge air situated in the cylinder is injected. Here, it is not uncommon for enrichment factors of 10 and greater to be realized, wherein the enrichment factor indicates the ratio of fuel mass actually supplied to stoichiometric fuel mass. The aim of said measure is, by way of the excess of fuel, to evaporate an amount of fuel adequate to ensure a reliable ignition.

Embodiments of the method are advantageous in which, with increasing operating temperature proceeding from a state in which the internal combustion engine is cold, and with further increasing load beyond a point at which a predefinable load is reached, the spacing between the two electrodes is decreased.

Turning to FIG. 1, a first embodiment of ignition plug 1 is shown in side view and partially in section which comprises an electrode pair with two electrodes 2 and 3 spaced apart from one another. In FIG. 1 one electrode 2 of the electrode pair is in the form of a centrally arranged central electrode 4. The other electrode 3 serves as a ground electrode 5 which surrounds the central electrode 4 on the combustion chamber side in a similar manner to a cap. Here, openings are provided in a number sufficient to ensure that the fuel-air mixture can pass into an ignition gap 6, in which a spark path forms during the course of the applied ignition, between the two electrodes 2 and 3. An insulator 7 surrounds the centrally arranged central electrode 4 and electrically insulates the two electrodes 2, 3 from one another, wherein the insulator 7 itself is received in a threaded housing 8.

In this example the central electrode 4 is designed as a movable electrode 4, and the ground electrode 5 is rigidly connected to the threaded housing 8, that is to say is immovable. In other examples both the central electrode and the ground electrode 5 may be designed as movable. The central electrode 4 is displaceable in translatory fashion in the insulator 7, along the longitudinal axis 9 of the ignition plug 1, by means of the adjustment device 10. The adjustment device, for example, could comprise of a solenoid, temperature-reactive wax, or actuator. Further the adjustment device could be contained within the ignition plug or be external.

Here, the spacing between the two electrodes 2, 3 in the ignition gap 6 is adjusted by a translatory displacement (double arrow) of the central electrode 4, wherein the central electrode 4 is moved toward the ground electrode 5 in order to decrease the spacing in the ignition gap 6 and is moved away from the ground electrode 5 in order to increase the spacing in the ignition gap 6.

In this example, the adjustment device 10 comprises a temperature-reactive wax element 10*a* whose volume changes as a function of temperature. The change in volume of the wax element 10*a* leading to a movement of the central electrode 4 that is designed to be movable. For this purpose, the wax element 10*a* is arranged in a working chamber 10*c* in order to transform the change in volume resulting from an increase in temperature into an adjustment force. When the wax element 10*a* is activated by means of an increase in temperature, the spacing in the ignition gap 6 is decreased as a result of the movement of the central electrode 4 counter to the spring force of a restoring spring 10*b*. The wax element 10*a* may be activated, for example, by the engine operating temperature or a heater.

Figure 2:
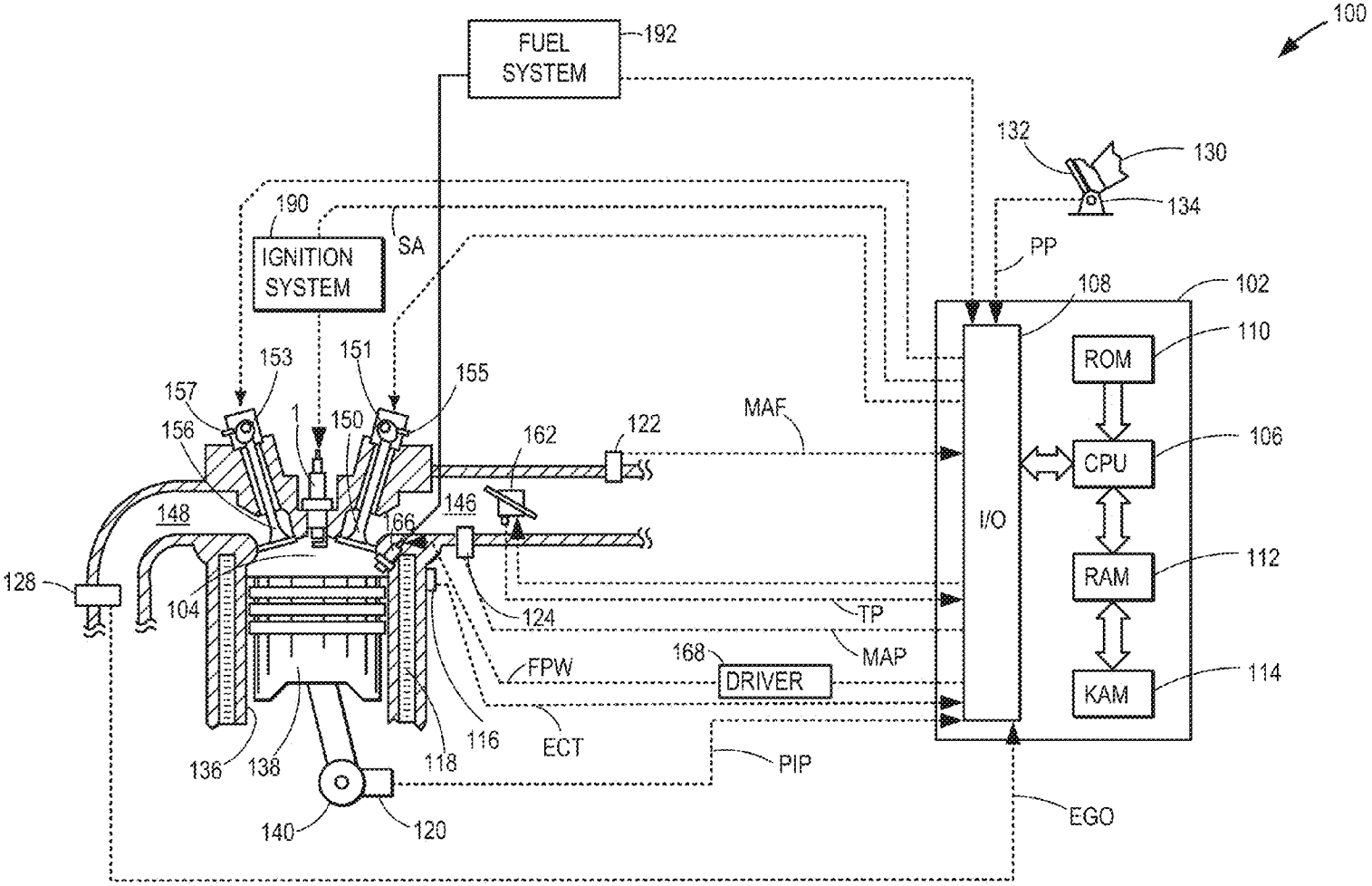
FIG. 2 shows an example of an internal combustion engine with an ignition plug.

Referring to FIG. 2, it shows one example of an internal combustion engine 100. Engine 100 is depicted with combustion chamber 104, coolant sleeve 118, and cylinder walls 136 with piston 138 positioned therein and connected to crankshaft 140. Combustion chamber 104 is shown communicating with intake passage 146 and exhaust passage 148 via respective intake valves 150 and exhaust valves 156. In the depicted view 100, as an example, only one cylinder is shown.

Intake valve 150 and exhaust valve 156 may be controlled by controller 02 using respective cam actuation systems including one or more cams depicted by an intake cam 151 and exhaust cam 153. The position of intake valve 150 and exhaust valve 156 may be determined by valve position sensors 155 and 157 respectively.

In some embodiments, at least one or more cylinders of engine 100 may include an ignition plug 1 for initiating combustion as described in FIG. 1. Ignition system 190 can provide an ignition spark after the ignition gap is adjusted for engine operating parameters, as described in FIG. 3, to combustion chamber 104 via ignition plug 1 in response to spark advance signal SA from controller 102.

FIG. 2 shows injector 166 as a side injector. Alternatively the injector may be located overhead of the piston near ignition plug 1. In an alternate embodiment, injector 166 may be a port injector providing fuel into the intake port upstream of cylinder 104.

Controller 102 is shown as a microcomputer, including microprocessor unit 106, input/output ports 108, an electronic storage medium for executable programs and calibration values shown only as read only memory chip 110 in this particular example, random access memory 112, keep alive memory 114, and a data bus. Storage medium read only memory 110 can be programmed with computer readable data representing instructions executable by processor 106 for performing the methods and routines described below as well as other variants that may be anticipated but not specifically listed.

Controller 102 may receive various signals from sensors coupled to engine 100. For example measurement of inducted mass air flow (MAF) from mass air flow sensor 122; engine coolant temperature (ECT) from temperature sensor 116 coupled to cooling sleeve 118; a profile ignition pickup signal (PIP) from Hall effect sensor 120 (or other type) coupled to crankshaft 140; throttle position (TP) from a throttle position sensor; absolute manifold pressure signal (MAP) from sensor 124 cylinder air-fuel ratio (AFR) from exhaust gas sensor (EGO) 128; and abnormal combustion from a knock sensor and a crankshaft acceleration sensor. Further, additional sensors not shown may be used.

Based on input from one or more of the above mentioned sensors, controller 102 may adjust the ignition gap 6 of one or more ignition plugs 1 or a given cylinder and engine operating parameters. The controller 102 may receive input data from the various sensors, process the input data, and respond to the processed input data based on instruction or code programmed therein corresponding to one or more routines. An example control method is described in FIGS. 3 and 4.

Figure 3:
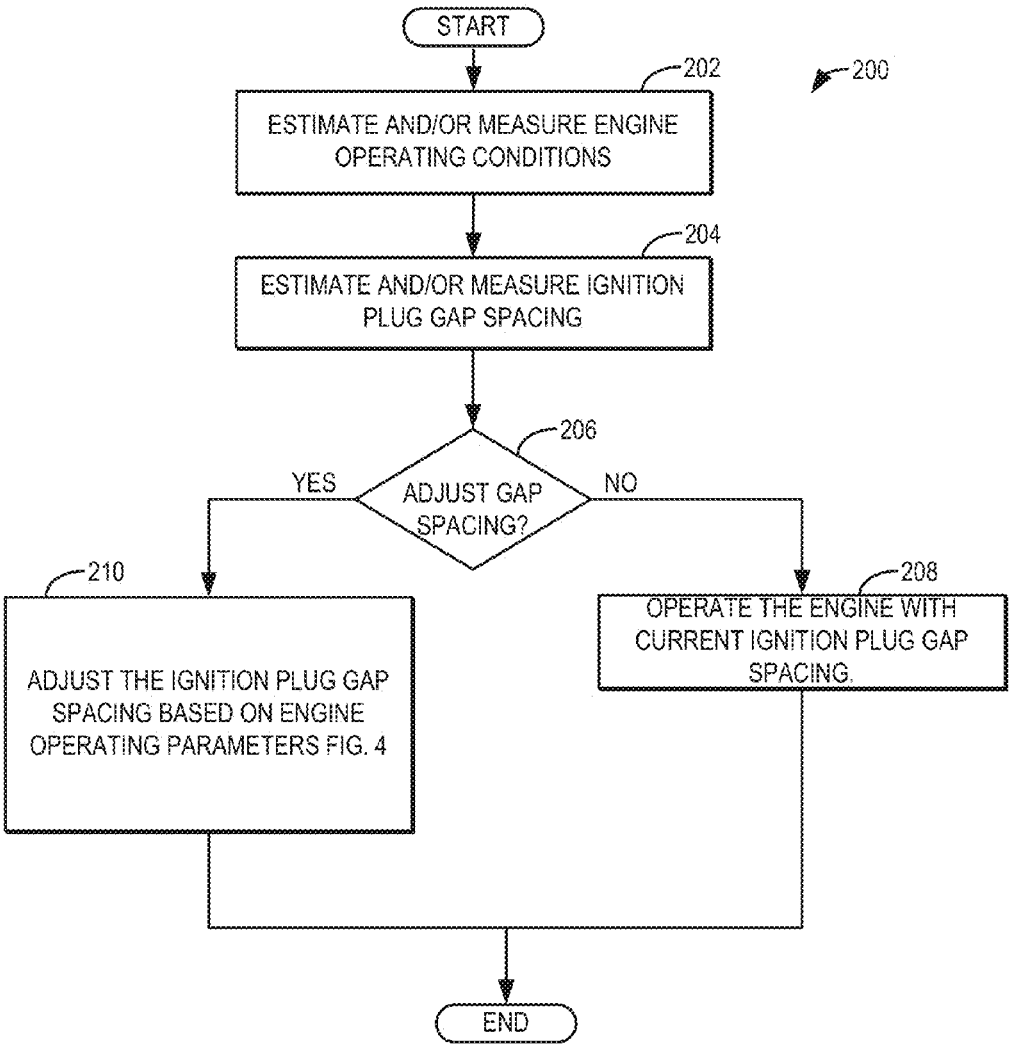
FIG. 3 shows an example method of operating an internal combustion engine with an ignition plug of the first embodiment.

Now turning to FIG. 3 a routine 200 is depicted to show the steps of operating a direct injection, applied ignition internal combustion engine 100 with an ignition plug 1. Specifically routine 200 enables the adjustment of the ignition plug gap spacing in view of the engine operating parameters and the ignition plug gap spacing in order to better enable reliable ignition under all engine operating conditions.

At 202, the engine operating conditions may be measured and/or estimated. These may include, for example, engine operating temperature, air ratio, engine load, exhaust gas recirculation (EGR) rate, ignition voltage, etc. FIG. 2 depicts examples of sensors which may be used in an internal combustion engine.

At 204, the ignition plug gap spacing may be measured and/or estimated. In one example, this may be done by looking up the last stored operating value in a look up table. In another example, this may also be done by applying a high voltage across the ignition plug electrodes and measuring the time until plug firing from a zero crossing of the voltage.

At 206, the routine may determine if adjustment of the ignition plug gap spacing is needed. For example, it may be determined if the current gap spacing needs adjustment to allow reliable ignition of the fuel when the engine is cold. If no ignition plug gap spacing adjustment is needed the routine may proceed to 208 and operate the engine with the current ignition plug gap spacing.

If at 206 it is determined that the ignition plug gap spacing requires adjustment the routine may proceed to 210. The ignition plug gap spacing is adjusted based on the engine operating parameters, FIG. 4 shows an example method used to determine the gap spacing increases or decreases in response to the various engine operating parameters.

Figure 4:
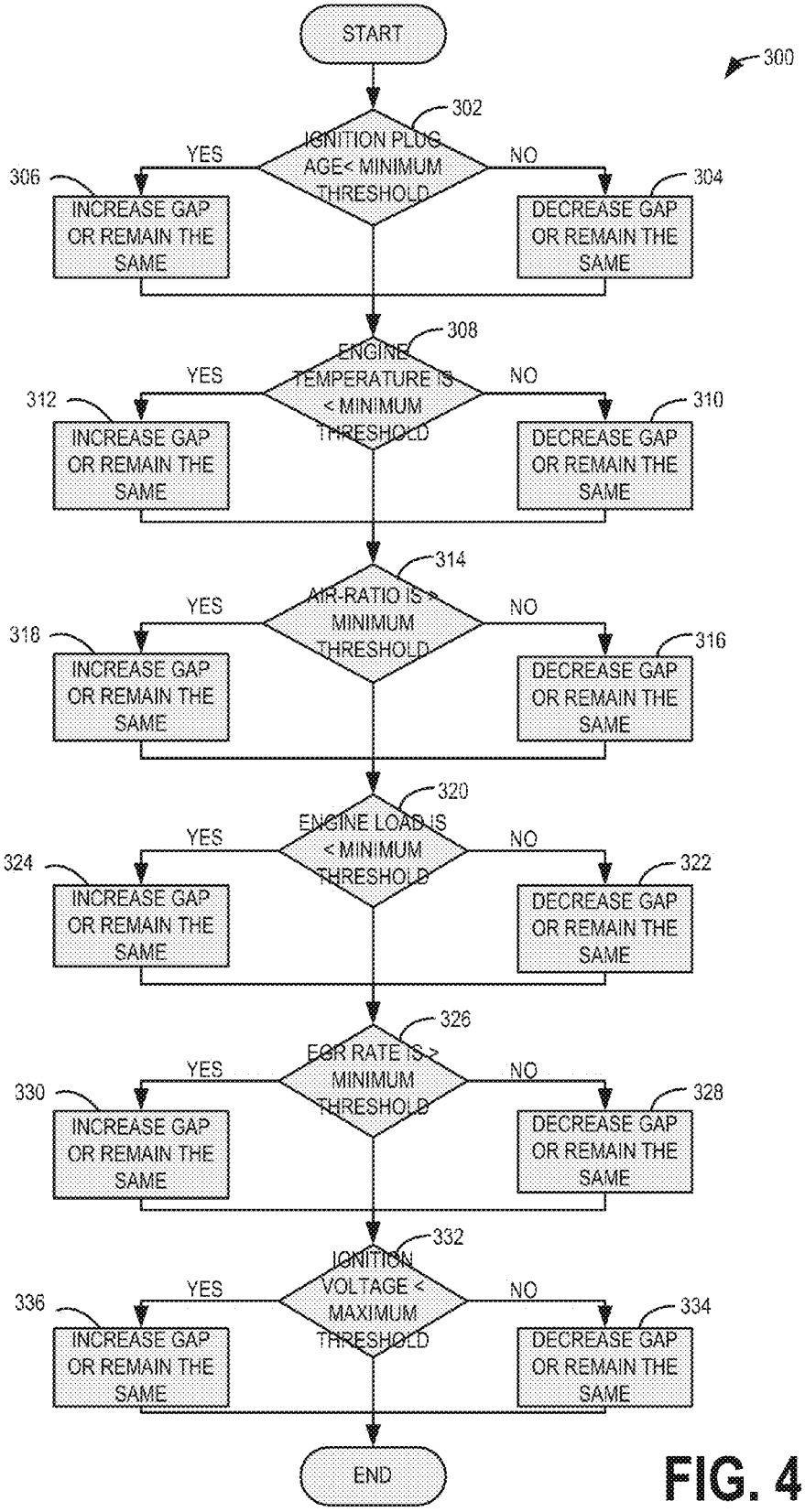
FIG. 4 schematically shows one example method to adjust the ignition plug gap spacing.

Turning now to FIG. 4 a routine 300 is illustrated for selecting engine operating parameters and the type of adjustment, increase, decrease, or remain the same, of the ignition plug gap spacing. The engine controller nay decide to acquire all gap adjustment settings from routine 300 before determining an ignition gap space adjustment value. Further, the controller may decide to include one or more of the engine operating parameters that may be measured and/or estimated.

At 302, the routine may determine if the ignition plug age is below a minimum threshold. During the lifetime of the ignition plug it is possible for an increase of the electrode spacing resulting from wear-induced burn off to occur. If the ignition pug is below a minimum age threshold, the routine may proceed to 306 where the ignition plug gap spacing may be increased or remain the same. If the ignition plug is above a minimum age threshold, the routine can proceed to 304 where the ignition plug gap spacing may be decreased or remain the same. This may help compensate for wear-induced burn of the electrodes. This may increase the service life of the ignition plug if the gap spacing increases as a result of wear with progressive operating durations, which in turn shift to greater ignition voltage to form a spark path resulting in increasing burn-off.

From both 304 and 306 or 302 if skipped, the routine proceeds to 308 where it may determine if the engine is operating below a minimum threshold temperature. For example, during a cold start the engine operating temperatures may be below the minimum threshold. To better enable reliable ignition of the air-fuel mixture a relatively large ignition gap spacing between the two electrodes is desirable. If yes, the routine may proceed to 312 and increase the ignition gap space or remain the same. If no, the routine may proceed to 310 and decrease the ignition gap space or remain the same. This may better enable reliable ignition of the air-fuel mixture at various engine operating temperatures.

From both 310 and 312 or 308 if skipped, the routine proceeds to 314 where it may determine if the overall air ratio $\lambda$ is above a minimum threshold. For example, during operation of an Otto-cycle engine, the overall air ratio $\lambda$ variation may lead to greater demands on the ignition plug. Generally internal combustion engines are operated lean ($\lambda>1$) with an excess of air and possibly also rich ($\lambda<1$) with an air deficiency. To better enable reliable ignition of the air-fuel mixture, the ignition plug gap spacing should be adjusted. For example with lean mixtures a relatively large ignition gap is selected in order that an adequately large proportion of fuel molecules pass into the ignition gap in which the spark path is formed. If yes, the routine proceeds to 318 and increases the ignition gap space or remains the same. If no, the routine proceeds to 316 and decreases the ignition gap space or remains the same. From both 316 and 318 or 314 if skipped, the routine proceeds to 320 where it may determine if the engine load is below a minimum threshold. For example, an engine operating with high load and/or full load, a small spacing of the electrodes is selected. If yes, the routine proceeds to 324 and increases the ignition gap space or remains the same. If no, the routine proceeds to 322 and decreases the ignition gap space or remains the same.

From both 322 and 324 or 320 if skipped, the routine proceeds to 326 where it may determine if the exhaust gas recirculation EGR rate is above a minimum threshold. For example, increasing the EGR rate may reduce the nitrogen oxide emissions. Furthermore at high loads the EGR rate may be set to reduce the knocking tendency. At high EGR rates larger electrode spacing is selected in order to better enable reliable ignition of the air-fuel-exhaust mixture with an acceptable voltage ignition. If yes, the routine proceeds to 330 and increases the ignition gap space or remains the same. If no, the routine proceeds to 328 and decreases the ignition gap space or remains the same.

From both 328 and 330 or 326 if skipped, the routine proceeds to 332 where it may determine if the ignition voltage is below a maximum threshold. Reduced electrode spacing is selected if the ignition voltage considered for reliable ignition rises to an undesirably high value. Higher ignition voltages may result in increased burn-off and higher wear of the ignition plug, thereby decreasing the service life. If yes, the routine may proceed to 336 and increase the ignition gap space or remain the same. If no, the routine may proceed to 334 and decrease the ignition gap space or maintain it the same. Further, there may be set a second upper threshold beyond which the ignition space gap may not be set to help reduce excess ignition plug wear.

The invention claimed is:

1. An ignition plug for igniting a fuel-air mixture in a cylinder of a direct-injection, applied-ignition internal combustion engine, comprising:

an ignition plug having at least one electrode pair which comprises two electrodes which are electrically insulated with respect to and spaced apart from one another, of which a first electrode serves as a ground electrode and surrounds a second electrode, a spacing between the first electrode and the second electrode in an ignition gap, in which a spark path forms during a course of an applied ignition, being variable, wherein at least one of the two electrodes is designed to be movable for the purpose of adjustment of the spacing in the ignition gap, for which purpose an adjustment device is provided, and wherein the adjustment device includes a temperature-reactive wax element that is arranged in a working chamber and above a spring, the spring above the second electrode, and when the temperature-reactive wax is activated by an increase in temperature, the wax is positioned to expand against a spring force to move the second electrode.

2. The ignition plug as claimed in claim 1, wherein the adjustment device is controlled by an engine controller with instructions for increasing the spacing between the first and second electrode responsive to an air-fuel ratio in the cylinder being leaner than a lean threshold.

3. The ignition plug as claimed in claim 1, wherein a central electrode is provided which is arranged in a housing of the ignition plug and which is electrically insulated from the ground electrode by means of an insulator.

4. The ignition plug as claimed in claim 3, wherein the central electrode is the at least one electrode that is designed to be movable, the ground electrode being designed to be immovable.

5. The ignition plug as claimed in claim 4, wherein the central electrode is displaceable in translatory fashion in the housing by means of the adjustment device, the ground electrode being rigidly connected to the housing.

6. The ignition plug as claimed in claim 1, wherein the temperature-reactive wax element, when activated by means of an increase in temperature, effects a reduction of the spacing in the ignition gap as a result of a movement of the second electrode.

7. The ignition plug as claimed in claim 1, wherein the temperature-reactive wax element is actively controllable.

8. The ignition plug as claimed in claim 7, wherein the temperature-reactive wax element is actively controllable by means of a heating element and an engine controller.

9. An engine control method, comprising:

adjusting a spacing between a first electrode and a second electrode of an ignition plug via code stored in memory of a controller with a temperature-reactive wax element arranged in a chamber above a spring, the spring above the electrodes; and electrically heating the temperature-reactive wax element to change the spacing in response to an air-fuel ratio via the controller;

the first electrode surrounding the second electrode.

10. The method as claimed in claim 9 wherein the spacing is adjusted by the controller responsive to at least one further operating parameter of the engine, wherein the spacing is set variably during engine operation while the engine carries out combustion.

11. The method as claim in claim 10 wherein the spacing is increased with an increased exhaust gas recirculation rate.

12. The method as claimed in claim 11 wherein the spacing is increased in response to an increased plug age, the plug age determined by the controller based on a number of engine hours, vehicle miles, or combinations thereof.

13. The method as claimed in claim 12 wherein the spacing is further adjusted based on engine temperature.

14. The method as claimed in claim 13 wherein the spacing is increased responsive to the air-fuel ratio in a cylinder being leaner than a lean threshold.

15. The method as claimed in claim 14 further comprising adjusting the spacing responsive to an ignition voltage.

16. The method as claimed in claim 15 further comprising adjusting the spacing responsive to an engine load.

17. The method as claimed in claim 16 wherein the wax element is electrically controllable via the controller utilizing an on-board battery.

* * * * *